US005199277A

United States Patent [19]

Granström et al.

[11] Patent Number: 5,199,277

[45] Date of Patent: Apr. 6, 1993

[54] REFRIGERATOR WITH MEANS TO MOUNT AN EVAPORATOR

[75] Inventors: Lars T. Granström; Leif J. E. Strindberg, both of Täby, Sweden

[73] Assignee: Aktiebolaget Electrolux Luxbacken, Stockholm, Sweden

[21] Appl. No.: 851,744

[22] Filed: Mar. 16, 1992

[51] Int. Cl.[5] ..... F25D 19/00

[52] U.S. Cl. ..... 62/298; 62/466; 165/78; 248/221.4

[58] Field of Search ..... 62/465, 466, 521-523, 62/298; 165/67, 78; 29/453; 248/221.4; 52/222, 407

[56] References Cited

U.S. PATENT DOCUMENTS

| | | | |
|---|---|---|---|
| 1,471,020 | 10/1923 | Zahner | 52/222 X |
| 2,754,663 | 7/1956 | Horvay et al. | 62/465 X |
| 2,900,807 | 8/1959 | Solley, Jr. et al. | 62/523 X |
| 3,390,495 | 7/1968 | Dalby | 52/222 |
| 4,073,111 | 2/1978 | Warren | 52/407 |
| 4,437,282 | 3/1984 | O'Brien | 52/407 |
| 4,453,585 | 6/1984 | Ruggeberg, Sr. et al. | 52/222 X |
| 4,571,897 | 2/1986 | Kerr | 52/222 X |

FOREIGN PATENT DOCUMENTS

| | | | |
|---|---|---|---|
| 325217 | 7/1989 | European Pat. Off. | 62/465 |

*Primary Examiner*—William E. Tapolcai

*Attorney, Agent, or Firm*—Pearne, Gordon, McCoy & Granger

[57] ABSTRACT

A refrigerator (12) shows a chamber (10) cooled by a vertical, substantially plane and rectangular evaporator (16) mounted in the chamber (10) by being snapped at two vertical edges (22) into vertical grooves in two opposite walls (26) of the chamber (10).

2 Claims, 2 Drawing Sheets

REFRIGERATOR WITH MEANS TO MOUNT AN EVAPORATOR

BACKGROUND OF THE INVENTION

The invention refers to a refrigerator having a chamber which is kept refrigerated by a vertical, substantially planar and rectangular evaporator arranged in the chamber.

A refrigerator with such an evaporator is known through British patent No. 1 540 589. The known evaporator is kept in place by holders mounted on a rear wall of the chamber. The evaporator is provided with through holes by which it is snapped onto the holders, which protrude a bit through the respective hole and form an unevenness on the outside of the evaporator.

The object of the invention is to bring about a refrigerator with an evaporator which is simple and cheap to mount and which shows an imperforate outside which is easy to keep clean.

This object is attained by the refrigerator according to the invention thereby that the evaporator at two vertical edges is snapped into indentations in opposite vertical walls of the chamber.

BRIEF DESCRIPTION OF THE DRAWINGS

Embodiments of a refrigerator according to the invention are described below in connection to the enclosed drawings, wherein.

DETAILED DESCRIPTION OF THE PREFERRED EMBODIMENTS

Figure 1:
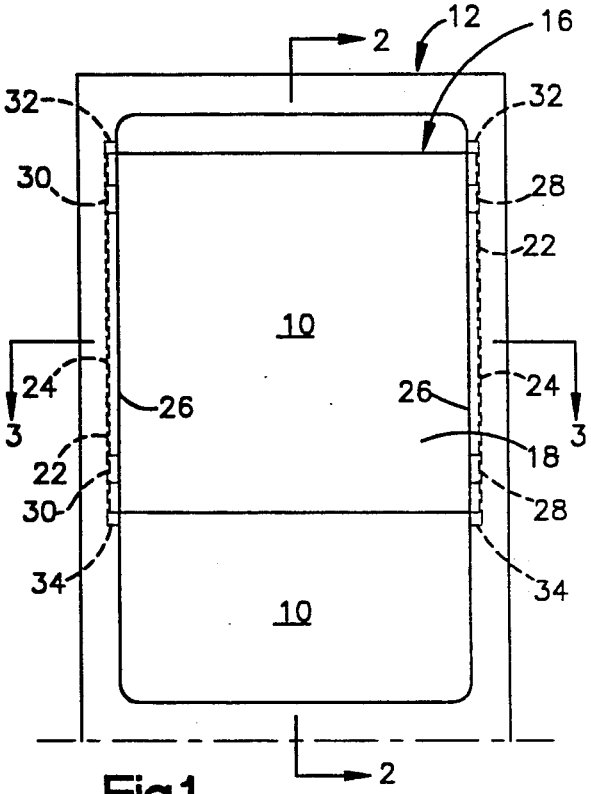
FIG. 1 shows a chamber of a refrigerator, from which a door has been removed so that an evaporator has become visible.
Figure 2:
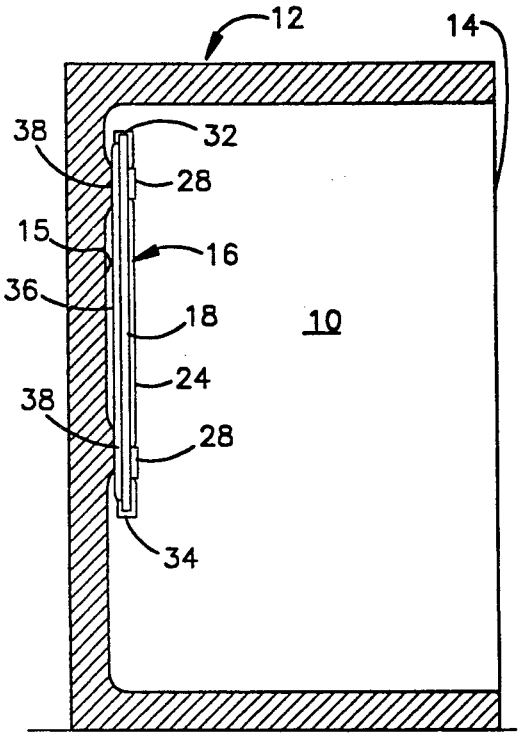
FIG. 2 shows a sectional view according to the marking 2-2 in FIG. 1.
Figure 3A:
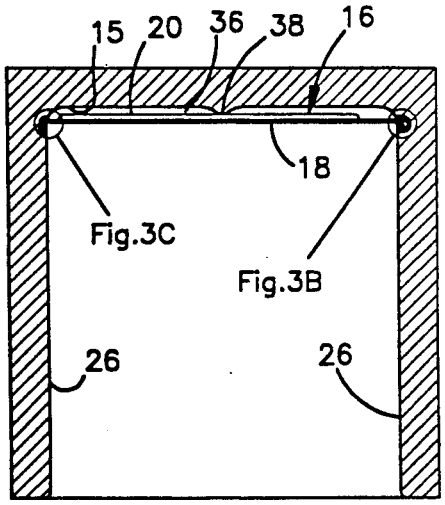
FIG. 3A shows a sectional view according to the marking 3-3 in FIG. 1.
Figure 3B:
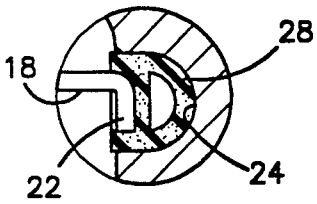
FIG. 3B is an enlarged view of a portion of FIG. 3A of the evaporator mounted in one of the mounting grooves.
Figure 3C:
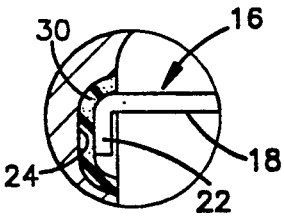
FIG. 3C is an enlarged view of a portion of FIG. 3A of the evaporator mounted in the other of the mounting grooves.

Storing chamber 10 in a refrigerator 12 is designated in FIGS. 1 and 2. The chamber 10 is available through an opening 14, which is closable by a door, (not shown). The chamber 10 is kept refrigerated by an evaporator 16 which is arranged vertically close to a rear wall 15 in the chamber and is connected to a refrigerating apparatus (not shown). The evaporator 16 consists of a rectangular plate of metal, in which plate ducts for a refrigerant are arranged. The visible front side 18 of the evaporator is quite planar while its hidden back 20 shows protuberances, under which said ducts are located. Such an evaporator is known per se through e.g. FIGS. 8 and 10 of U.S. Pat. No. 2,690,002. The vertical edges of the evaporator show a band-formed part 22 which forms a right angle with the front side 18. The evaporator rests with the parts 22 in vertical grooves 24 in the side walls 26 of the chamber. In one of the grooves 24 two resilient, tubular elements 28 are arranged at a distance from each other (FIGS. 1 and 2). The elements 28 press the evaporator against the other groove 24 via two silencing elastic intermediate elements 30 located in the other groove, as shown in FIGS. 3A, 3B, and 3C.

Figure 4A:
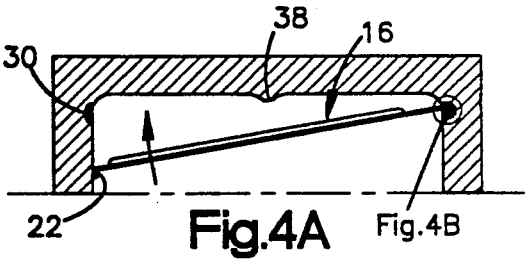
FIG. 4A shows in the same sectional view as FIG. 3A how the evaporator is mounted.
Figure 4B:
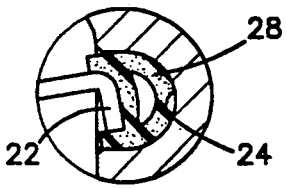
FIG. 4B is an enlarged view of a portion of FIG. 4A showing the mounting of the evaporator in one of the mounting grooves.

The mounting of the evaporator is simple, see FIGS. 4A, and 4B which show how one of the vertical edges 22 of the evaporator is brought against the element 28 in one of the grooves 24, after which the other vertical edge of the evaporator is brought against the other groove 24 until it snaps into the groove by the spring force from the element 28. Upper and lower edges, 32 and 34, respectively, of the grooves 24 fix the position of the evaporator vertically. A gap 36 is arranged between the wall 15 and the evaporator for circulation of air which is refrigerated by the back 20 of the evaporator. Two protrusions 38 of the wall 15 constitute supports for the evaporator in the gap 36.

Figure 5:
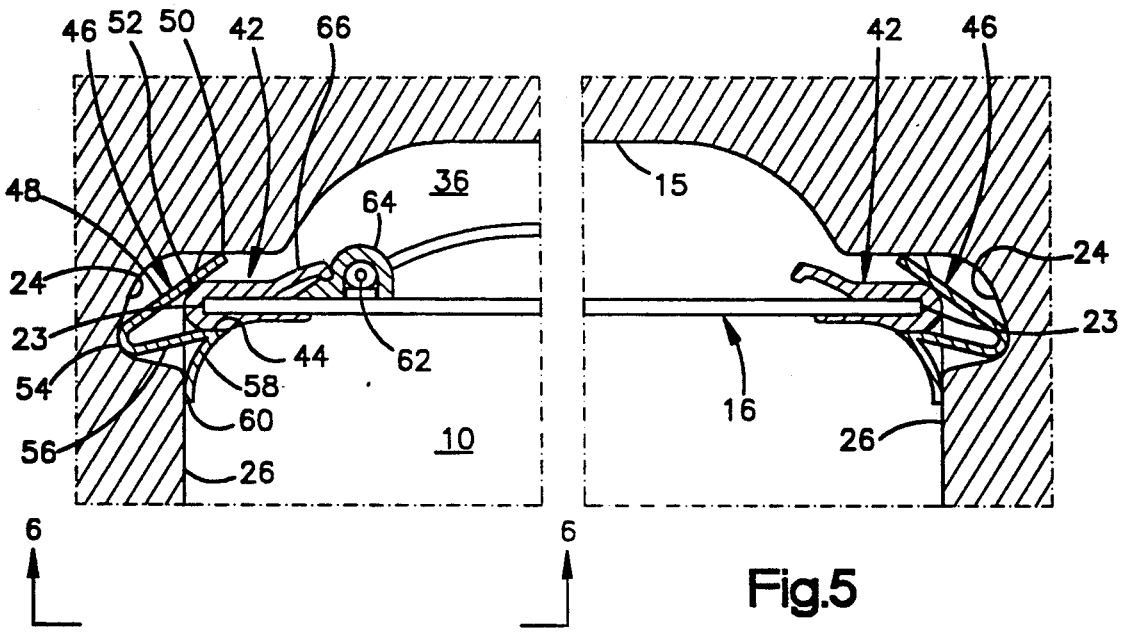
FIG. 5 shows a further embodiment of the evaporator in the same sectional view as FIG. 3A.
Figure 6:
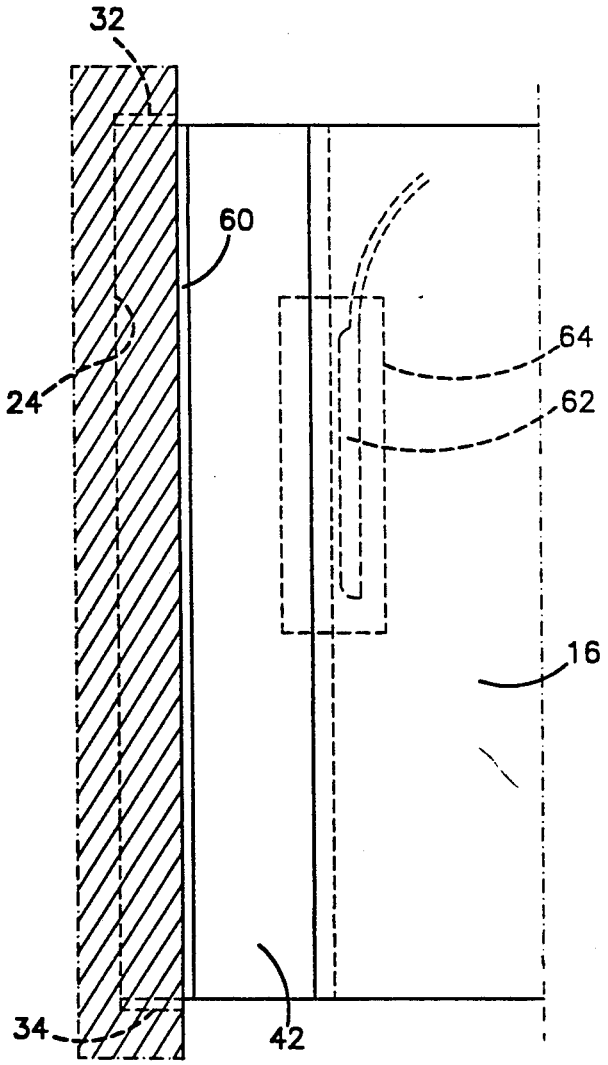
FIG. 6 shows a view according to the marking VI in FIG. 5.

In the embodiment according to FIGS. 5 and 6 vertical edges 23 of the evaporator 16 are surrounded by a strip 42 having a U-formed cross section. The strip 42, which is of relatively hard plastic, is clamped onto the evaporator 16. An elastic profile 46 having a Z-formed cross section is fastened to the strip 42 at 44. A first leg 48 of the profile 46 bears at its one end 50 on the groove 24, between its ends on the strip 42 at 52 and at its other end 54, where the leg 48 continues as a second leg 56, on the bottom of the groove 24. The second leg 56 continues at the fastening place 44 as a third leg 58, which at its free end 60 bears on the wall 26 and forms a smooth transition between the strip 42 and the wall 26.

A temperature sensing means 62 for the operation of the refrigerator is held in heat conductive contact with the evaporator 16 by a holder 64 which is wedged between one leg 66 of the strip 42 and the evaporator 16 on the back of the evaporator. The strip 42 and the profile 46 extend both along the full height of the evaporator.

In the embodiment according to FIGS. 5 and 6 the evaporator is mounted in the grooves 24 with the strips 42 with the profiles 46 and the temperature sensing means 62 fastened to the evaporator 16.

We claim:

1. A refrigerator having a chamber which is kept refrigerated by a vertical, substantially planar and rectangular evaporator arranged in the chamber, wherein the evaporator at two vertical edges is snapped into indentations in opposite vertical walls of the chamber, the evaporator at its respective vertical edges rests in an indentation in the form of a vertical groove, resilient means are arranged between at least the bottom of one of the grooves and the corresponding edge of the evaporator, which resilient means press the evaporator against the other groove, and the evaporator at its respective vertical edge is surrounded by a strip having a U-formed cross section to which the resilient means are fastened.

2. Refrigerator according to claim 1, a temperature sensing means for the operation of the refrigerator being arranged in heat conductive contact with the evaporator, wherein the temperature sensing means is arranged in a holder which is wedged between one leg of the strip and the evaporator.

* * * * *